US012203663B1

(12) United States Patent
Horner et al.

(10) Patent No.: US 12,203,663 B1
(45) Date of Patent: Jan. 21, 2025

(54) COMPOSITE DIAPHRAGM EXPANSION VESSELS

(71) Applicant: Enpress LLC, Eastlake, OH (US)

(72) Inventors: Douglas M. Horner, Gates Mills, OH (US); Douglas S. Stolarik, Mentor, OH (US)

(73) Assignee: ENPRESS LLC, Eastlake, OH (US)

( * ) Notice: Subject to any disclaimer, the term of this patent is extended or adjusted under 35 U.S.C. 154(b) by 0 days.

(21) Appl. No.: 18/351,130

(22) Filed: Jul. 12, 2023

Related U.S. Application Data

(63) Continuation of application No. 17/168,407, filed on Feb. 5, 2021, now abandoned.

(60) Provisional application No. 62/972,738, filed on Feb. 11, 2020, provisional application No. 62/971,258, filed on Feb. 7, 2020.

(51) Int. Cl.
*F24D 3/10* (2006.01)

(52) U.S. Cl.
CPC ..... *F24D 3/1008* (2013.01)

(58) Field of Classification Search
CPC .... F24D 3/1008; F24D 3/1016; F24D 3/1025; F24D 3/1033; F24D 3/1041
See application file for complete search history.

(56) References Cited

U.S. PATENT DOCUMENTS 5,386,925 A * 2/1995 Lane ..... F24D 3/1008 220/721
2004/0173624 A1* 9/2004 Carter ..... F24D 3/1008 220/720
2015/0083234 A1* 3/2015 DiNovo ..... B65D 90/22 137/577
2019/0085536 A1* 3/2019 Wideman ..... E03B 11/06

FOREIGN PATENT DOCUMENTS

GB 2565813 A * 2/2019 ..... A47J 43/27

* cited by examiner

*Primary Examiner* — Edelmira Bosques
*Assistant Examiner* — Brett Peterson Mallon
(74) *Attorney, Agent, or Firm* — Rankin, Hill & Clark LLP

(57) ABSTRACT

A polymer ring assembly for securing a diaphragm to an inner side of a polymeric vessel, a fiber-reinforced polymeric vessel containing a diaphragm secured using a polymer ring assembly and a method of manufacturing the same. The polymer ring assembly allows for the production of high-quality diaphragm expansion vessels, without the use of metal vessel bodies and metal retaining rings. Also, a ring assembly for securing a diaphragm to an inner side of a polymeric vessel, a fiber-reinforced polymeric vessel containing a diaphragm secured using a ring assembly and a method of manufacturing the same.

2 Claims, 2 Drawing Sheets

COMPOSITE DIAPHRAGM EXPANSION VESSELS

PRIORITY CLAIMS

This application claims priority to U.S. Provisional App. Ser. No. 62/971,258, filed Feb. 7, 2020, and to U.S. Provisional App. Ser. No. 62/972,738, filed Feb. 11, 2020, both of which are hereby incorporated by reference in their respective entireties.

BACKGROUND OF INVENTION

Field of Invention

The present invention relates to diaphragm expansion vessels and, more particularly to composite glass-fiber wound polymeric diaphragm expansion vessels and methods for manufacturing the same.

Brief Description of Related Art

A variety of expansion tanks/vessels are well known in the art. Early examples include the design shown in Kirk, Jr., U.S. Pat. No. 3,524,475. In this example, and in most other prior art designs, a flexible diaphragm made of rubber is disposed inside a tank body. The periphery of the diaphragm is held in contact with an inner side of the tank body using a retaining ring, which presses the diaphragm into a channel formed in the side of the tank body. The retaining ring and tank body are both typically made of metal.

BRIEF SUMMARY OF THE INVENTION

The present invention provides embodiments of composite glass-fiber wound polymeric diaphragm expansion vessels. In one primary embodiment, a polymer ring assembly reliably secures a flexible diaphragm to an inner side of a polymeric vessel resulting in a polymeric vessel containing a flexible diaphragm secured using the polymer ring assembly. In another primary embodiment, a metal snap ring reliably secures the diaphragm to an inner side of the vessel. Both embodiments allow for the production of high-quality diaphragm expansion vessels.

The foregoing and other features of the inventions are hereinafter more fully described below, the following description setting forth in detail certain illustrative embodiments of the inventions, these being indicative, however, of but a few of the various ways in which the principles of the present inventions may be employed.

BRIEF DESCRIPTION OF THE DRAWINGS

With reference to the accompanying drawing figures, please note that.

DETAILED DESCRIPTION OF THE INVENTION

A. First Primary Embodiment

Figure 1:
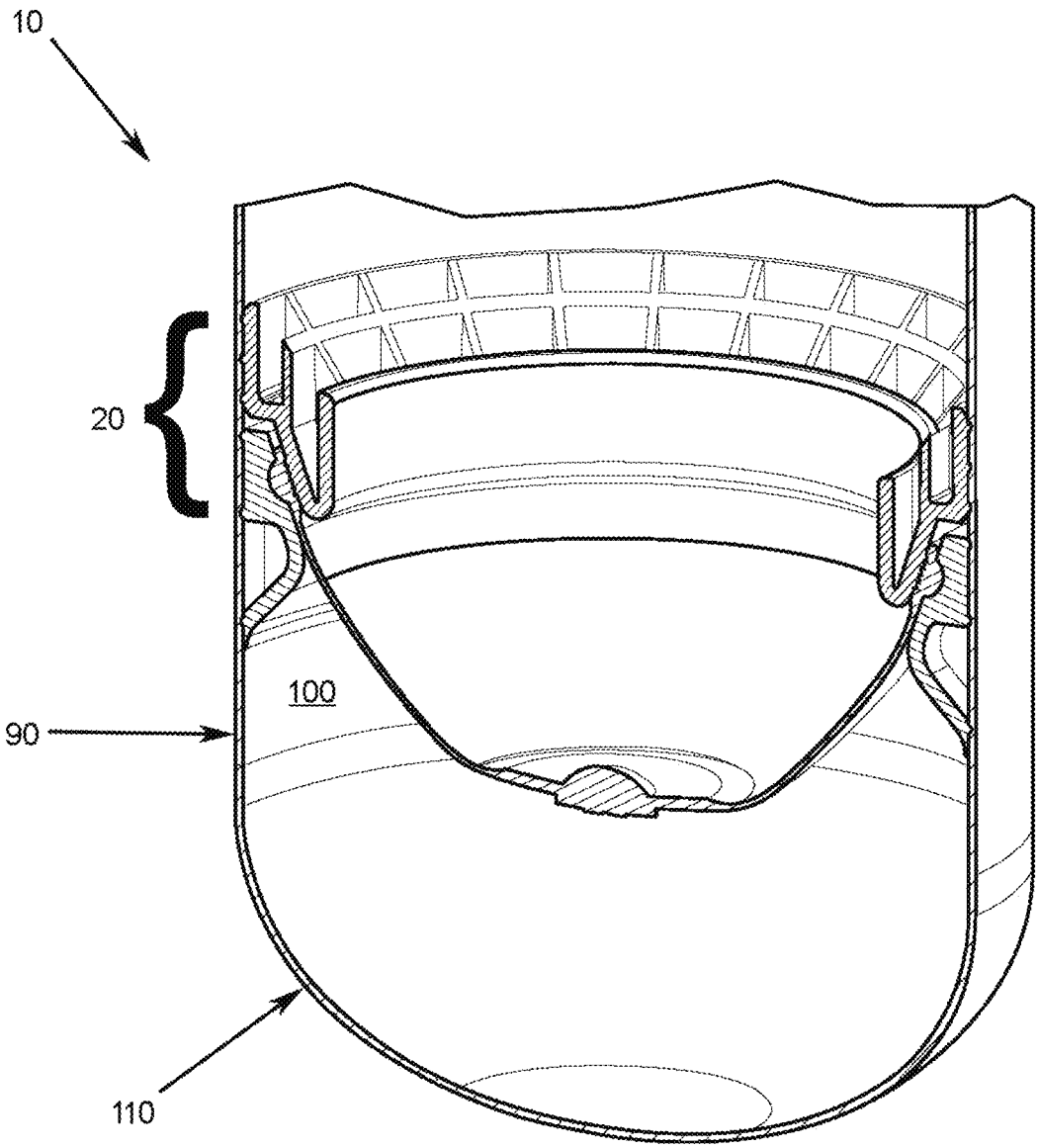
FIG. 1 is a section view of a lower half of a diaphragm expansion vessel before reinforcing fibers have been applied to an outer surface thereof.
Figure 2:
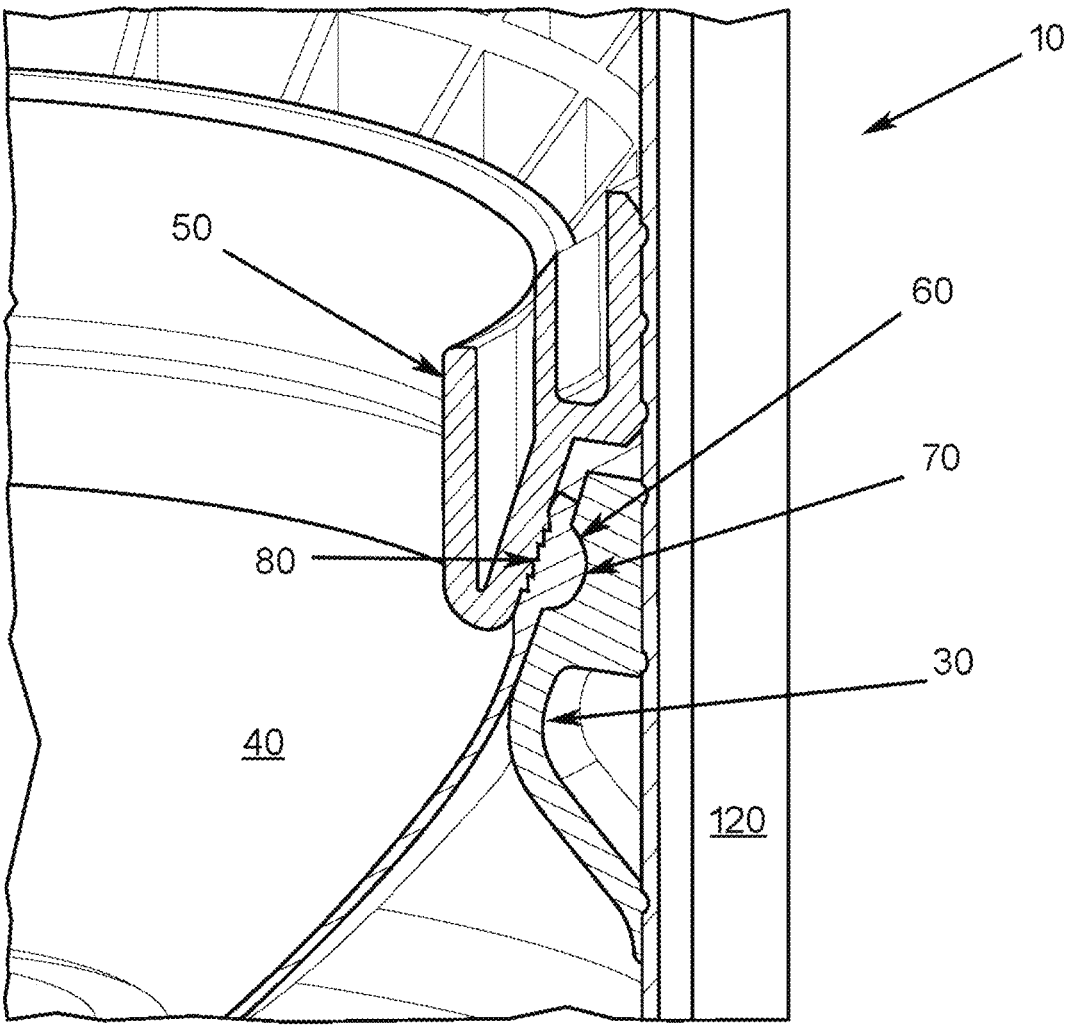
FIG. 2 is a section view of a portion of a diaphragm expansion vessel after the reinforcing fibers have been applied to an outer surface thereof.

With reference to FIGS. 1 and 2, a diaphragm expansion vessel 10 according to the invention comprises a polymer ring assembly 20 that is spin-welded to an inner side 100 of a polymeric vessel 90. The polymer ring assembly comprises an upper ring 50 and a lower ring 30, which clench a diaphragm 40 therebetween.

The diaphragm is fabricated from an elastomeric material and is generally bowl-shaped. The diaphragm includes a circumferential outwardly bulging lip spaced inward proximal to an outer rim of the diaphragm.

The lower ring is a composite structure comprising a molded polymeric annular portion and a reinforcing band portion. The lower ring has an inner side and an outer side. The outer side includes a plurality of spin weld beads, which are circumferential ridges or bumps that face the inner wall of the polymeric vessel. The spin weld beads constitute friction points, which rapidly melt when the ring is rotated relative to the inner wall of the polymeric vessel during a spin-welding process and then re-solidify to form a weld when rotation ceases.

The inner side of the lower ring includes a beveled portion provided with a channel that is complementary in shape to, and is configured to receive, the bulging lip of the diaphragm. The reinforcing band portion is positioned on the outer side of the beveled portion, opposite the channel. The reinforcing band portion can be formed of metal or a polymeric structure that is reinforced by fiberglass wrap to provide hoop strength to resist outward force. It will be appreciated that injection molding of the retaining ring may result in an out-of-round condition common to injection molded parts. The out-of-round condition can be problematic in spin-welding operations. To eliminate and/or greatly minimize the out-of-round condition, one can apply fiberglass rovings under tension while the retaining ring is fixtured over a nearly-perfectly round mandrel, turned true so that it displays little or no out-of-round condition. If fiberglass rovings are wetted with an epoxy resin-catalyst mixture, and the mixture is allowed to cure while the retaining ring is fixture over the round mandrel, the retaining ring will conform to and assume the round shape of the mandrel. A gap is preferably provided between the outer side of the reinforcing band portion and the inner sidewall of the vessel so that the outer side of the reinforcing band portion does not interfere with the spin-welding operation. The band portion can be co-molded with the polymeric annular portion or, as explained above, it can be formed on the polymeric annular portion after it has been molded and covered by winding adhesive-coated fibers under tension.

A plurality of vanes are present on the outer side of the lower ring beneath the reinforcing band portion, which provide structural support and strength to the lower ring.

The upper ring is a molded polymeric structure having an inner side, an outer side, an upper side and a lower side. The upper side is provided with a plurality of pockets, which function as drive sockets or features that receive drive pins and thus allow the upper ring to be rotated (i.e., to spin) relative to the polymeric vessel during a spin-welding operation. The inner side is preferably smooth, which prevents damage to the diaphragm that contacts the inner side during use. The outer side includes a plurality of spin weld beads, which are circumferential ridges or bumps that face the inner wall of the polymeric vessel when the ring assembly is spin-welded to the polymeric vessel. The spin weld beads constitute friction points, which rapidly melt and then re-solidify to form the spin weld when rotation ceases. The lower side of the upper ring includes a plurality of teeth 80 in the form of a series of circumferential ridges and valleys. The teeth are configured to engage the diaphragm on a side opposite the bulging lip when the upper ring and lower ring are compressed together with the diaphragm captured or clenched therebetween. The diaphragm, when so compressed, forms an air-tight and water-tight seal between the upper ring and the lower ring.

To fabricate a polymeric diaphragm expansion vessels according to the invention, the bulging lip of the diaphragm is placed in the channel of the lower ring, and then the upper ring is pressed toward the lower ring and diaphragm until the teeth are compressed into the diaphragm. Compression can be accomplished by mechanical means or by pressure (vacuum or air pressure) either before or after the assembly has been placed into the polymeric vessel. Once the assembly has been positioned where desired within the polymeric vessel, the entire assembly (upper ring, lower ring and diaphragm) is then temporarily rotated relative to the polymeric vessel at high speed to spin-weld the compressed assembly to the inner sidewall of the polymeric vessel. This spin-weld forms an air-tight and water-tight seal between the assembly and the polymeric vessel. As noted above, an air-tight and water-tight seal is formed between the upper ring and the lower ring by the diaphragm, which spans across the polymeric vessel and divides it into a water side and an air side.

In an alternative embodiment of the invention, instead of a channel, the lower ring includes a recessed area 70 that includes a cylindrical wall portion that is concentric with the cylindrical inner wall of the polymeric vessel, and an arcuate portion below the cylindrical wall portion. In this alternative embodiment, the diaphragm includes a lip 60 having a complementary shape to the arcuate portion of the recessed area and some or all of the cylindrical wall portion. This allows the lower ring to be molded without the need for a secondary channel-forming operation, or without the need for expensive mold tooling to form the channel.

In this alternative embodiment, the upper ring includes a T-shaped reinforcing insert, which is co-molded with the upper ring. The reinforcing insert is opposite the band portion of the lower ring when the entire assembly is spin-welded to the polymeric vessel. The reinforcing insert can be formed of metal or other suitable reinforcing material.

The upper side of the lower ring includes a V-shaped slot, and the bottom side of the upper ring includes a V-shaped ridge that is configured to be received within the slot in the lower ring when the entire assembly is fully assembled. This provides added structural strength and ensures proper alignment of the upper and lower rings.

In yet another alternative embodiment, no reinforcing insert is present. Instead, the lower portion of the lower ring is enlarged, and includes additional spin weld beads, which allows the lower portion to be welded to the inner side of the vessel and provide the resistance against outward pressure. It will also be noted that the location of the slot and ridge are reversed as compared to the prior alternative embodiment. In other words, the slot is formed in the upper ring and the ridge is formed in the lower ring. Furthermore, the slot and ridge are rectangular-shaped. Other shapes can be utilized, and an O-ring can be placed in the slot to provide further sealing. In yet another alternative embodiment, no reinforcing band portion is included on the lower ring. In yet another embodiment of the invention.

The polymer ring assembly can be prepared for spin welding to an inner wall of a polymeric vessel using vacuum compression, which pulls down the diaphragm into a "pulled down" state due to the vacuum, which facilitates spin welding. Tooling for carrying out the method comprises a base comprising an upper portion and a lower portion. The upper portion has an upper face and a lower face. The lower face of the upper portion of the tooling base comprises a plurality of slots for receiving the upper ring of the polymer ring assembly. The upper face of the upper portion of the tooling base is configured to communicate with a spin-welding machine, such that rotation of the spin-welding machine results in the rotation of the tooling base. In a preferred embodiment, the lower portion of the tooling base is provided with three elevated, concentric, annular ridges which create annular pockets in the tooling base. A tooling top is preferably a disc like capping piece, which is placed atop the lower ring of the polymer ring assembly. To ensure a tight seal between the tooling top and the lower ring during vacuum compression, the tooling top is equipped with a circumferential seal.

The presently preferred method for constructing a vacuum compression assembly is done as follows. First, an upper ring of a polymer ring assembly is fitted into the slots of the tooling base. A diaphragm is then positioned on the upper ring, and then tucked into the annular pockets of the tooling base. A lower ring is fitted onto the bulging lip of the diaphragm, and a tooling top is positioned on the lower ring. The polymer ring assembly is sealed such that once a vacuum is applied to the sealed assembly, atmospheric pressure will maintain compression of the ring assembly. The sealed, compressed assembly can be fitted to a spin-welding machine and welded to the inner wall of a polymeric vessel. Once the spin weld operation has been completed, the tooling base and tooling top are removed from the polymer ring assembly.

The method of the invention thus also provides a method for manufacturing a diaphragm expansion vessel. In accordance with the method, the compressed polymer ring assembly is received by a spin-welding machine. Rapid rotation of the polymer ring assembly temporarily while the perimeter edge thereof is frictionally contacting the inner surface of the polymeric vessel. The generated friction creates local heating, which melt-fuses the polymer ring assembly to the inner side of the polymeric vessel, creating a fluid-tight seal. Once the polymer ring assembly has been spin-welded to the inner side of the polymeric vessel, a domed end cap 110 is spin welded to the open end of the polymeric vessel. Once the vessel has been sealed, with the polymer ring assembly welded inside, the vessel is preferably wrapped with a reinforcing overwrap layer comprising glass filaments 120, which may be coated with a thermosetting epoxy composition. The glass filaments are wrapped helically and circumferentially around the thermoplastic liner assembly. It will be appreciated that the use of fiber-reinforcing filaments is optional, and that the polymer ring assembly can be used to place a diaphragm in polymeric vessels that are formed by extrusion, blow molding or via rotational casting methods.

B. Second Primary Embodiment

In a second primary embodiment, a flexible diaphragm and a ring assembly are inserted into a polymeric vessel in preparation for the ring assembly to be spin-welded to an inner side of a polymeric vessel. The ring assembly comprises a retaining ring and a metal snap ring, which clench the diaphragm therebetween.

The diaphragm is fabricated from an elastomeric material and is generally bowl-shaped. The diaphragm includes a circumferential outwardly bulging lip spaced inward proximal to an outer rim.

The retaining ring of the ring assembly is a composite structure comprising a molded polymeric annular portion and a reinforcing band portion. The retaining ring has an upper side, a lower side, an inner side, and an outer side. The upper side of the retaining ring is provided with a plurality of pockets, which function as drive sockets or features that receive drive pins of a spin welding machine and thus allow the retaining ring to be rotated (i.e., to spin) relative to the polymeric vessel during a spin-welding operation. The lower side of the retaining ring is preferably smooth and featureless.

The outer side of the retaining ring includes a plurality of spin weld beads, which are circumferential ridges or bumps that face the inner wall of the polymeric vessel. The spin weld beads constitute friction points, which rapidly melt when the ring assembly is rotated relative to the inner wall of the polymeric vessel during a spin-welding process and then re-solidify to form a weld when rotation ceases.

The inner side of the retaining ring includes a channel that is complementary in shape to, and is configured to receive, the bulging lip of the diaphragm. The reinforcing band portion is positioned on the outer side of the annular portion, opposite the channel. The reinforcing band portion can be formed of metal or a polymeric structure that is reinforced by fiberglass wrap to provide hoop strength to resist outward force exerted by the snap-ring. It will be appreciated that injection molding of the retaining ring may result in an out-of-round condition common to injection molded parts. The out-of-round condition can be problematic in spin-welding operations. To eliminate and/or greatly minimize the out-of-round condition, one can apply fiberglass rovings under tension while the retaining ring is fixture over a nearly-perfectly round mandrel, turned true so that it displays little or no out-of-round condition. If fiberglass rovings are wetted with an epoxy resin-catalyst mixture, and the mixture is allowed to cure while the retaining ring is fixture over the round mandrel, the retaining ring will conform to and assume the round shape of the mandrel. A gap is preferably provided between the outer side of the reinforcing band portion and the inner sidewall of the vessel so that the outer side of the reinforcing band portion does not interfere with the spin-welding operation. The band portion can be co-molded with the polymeric annular portion or, as explained above, it can be formed on the polymeric annular portion after it has been molded and covered by winding adhesive-coated fibers under tension.

The metal snap ring comprises a metal strip, preferably being made from a band of steel. The snap ring has a first end and a second end. The snap ring is initially formed into a circular shape, with the first end extending inward and past the second end such that circular shape includes an overlapping portion. A joint plate is attached to the first end of the snap ring. The joint plate extends along three sides of the metal strip (all except the outwardly facing side) and extends beyond the first end of the snap ring. The joint plate may be attached to the snap ring by any conventional means, for example, welding. The metal snap ring is configured to be expanded within the retaining ring to capture and hold the flexible diaphragm to the retaining ring. A ring expanding machine can be used to expand the metal snap ring. The ring expanding machine presses against the inner side of the metal snap ring in equally spaced apart locations thereby increasing the size of the ring and causing the ends to approach one another. Once the second end passed the first end, the second end slips into the cavity of the joint plate attached to the first end. The two ends, now abutting, are retained in that configuration by the joint plate. The two ends can no longer separate, and the snap ring pressed firmly and circumferentially against the flexible diaphragm captured or clenched between the snap ring and the retaining ring.

To fabricate a polymeric diaphragm expansion vessels according to this embodiment of the invention, the bulging lip of the diaphragm is placed in the channel of the retaining ring, and then a metal snap ring is expanded and locked such that it provides outwards circumferential pressure on the diaphragm opposite the bulging lip, creating an air-tight and water-tight seal between the retaining ring and the snap ring. The diaphragm and snap ring can be joined to the retaining ring after the retaining ring has been spin-welded to the polymeric vessel. Or, more conveniently, the diaphragm and snap ring can be joined to the retaining ring before the retaining ring has been spin-welded to the polymeric vessel. The retaining ring, flexible diaphragm and snap ring can be joined to the polymeric vessel by spin-welding as an assembly.

In either process, the spin-weld forms an air-tight and water-tight seal between the retaining ring and the polymeric vessel. As noted above, an air-tight and water-tight seal is formed between the snap ring and the retaining ring by the diaphragm, which spans across the polymeric vessel and divides it into a water side and an air side.

The method of the invention thus also provides a method for manufacturing a diaphragm expansion vessel. In accordance with the method, a retaining ring assembly is received by spin-welding machine. The retaining ring is rapidly rotated relative to the polymeric vessel while perimeter edge of the retaining ring is frictionally contacting the inner surface of the polymeric vessel. The generated friction creates local heating, which melt-fuses the ring assembly to the inner side of the polymeric vessel, creating a fluid-tight seal. Once the ring assembly has been spin-welded to the inner side of the polymeric vessel, a domed end cap is spin welded to the open end of the polymeric vessel. Once the vessel has been sealed, with the ring assembly welded inside, the vessel is preferably wrapped with a reinforcing overwrap layer comprising glass filaments, which may be coated with a thermosetting epoxy composition. The glass filaments are wrapped helically and circumferentially around the thermoplastic liner assembly. It will be appreciated that the use of fiber-reinforcing filaments is optional, and that the ring assembly can be used to place a diaphragm in polymeric vessels that are formed by extrusion, blow molding or via rotational casting methods.

Additional advantages and modifications will readily occur to those skilled in the art. Therefore, the invention in its broader aspects is not limited to the specific details and illustrative examples shown and described herein. Accordingly, various modifications may be made without departing from the spirit or scope of the general inventive concept as defined by the appended claims and their equivalents.

What is claimed is:

1. A method for manufacturing a diaphragm expansion vessel comprising:

providing an assembly comprising a polymeric lower ring, an elastomeric diaphragm, and a polymeric upper ring, wherein a lip of the diaphragm is clenched between the lower ring and the upper ring by compressive force, wherein the lip of the diaphragm is received in a recess formed in the lower ring, wherein the upper ring comprises a plurality of teeth that engage the diaphragm, and wherein an air-tight and water-tight seal is formed between the lower ring and the upper ring by the diaphragm;

providing a polymeric vessel;

disposing the assembly within the polymeric vessel;

spin-welding the assembly to an inner side of the polymeric vessel;

closing off an open end of the polymeric vessel with an end cap; and wrapping the polymeric vessel and end cap with reinforcing fibers.

2. A diaphragm expansion vessel made according to the method of claim 1.

* * * * *